US008450698B2

(12) United States Patent
Hung et al.

(10) Patent No.: US 8,450,698 B2
(45) Date of Patent: May 28, 2013

(54) MULTI-STAGE ION AIRFLOW GENERATING DEVICE

(75) Inventors: Tsung-Liang Hung, Jhongli (TW); Chi-Hsiung Lee, Jhongli (TW); Yu-Hsiao Chao, Jhongli (TW); Nai-Chun Chang, Jhongli (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 401 days.

(21) Appl. No.: 12/906,288

(22) Filed: Oct. 18, 2010

(65) Prior Publication Data

US 2012/0049083 A1 Mar. 1, 2012

(30) Foreign Application Priority Data

Aug. 26, 2010 (CN) ..... 2010 2 0505491 U

(51) Int. Cl.
*H01T 23/00* (2006.01)
*H01T 19/04* (2006.01)

(52) U.S. Cl.
CPC ..... *H01T 23/00* (2013.01); *H01T 19/04* (2013.01)
USPC .. 250/423 R; 361/230; 361/231; 315/111.91; 250/324; 250/325

(58) Field of Classification Search
None
See application file for complete search history.

(56) References Cited

U.S. PATENT DOCUMENTS 3,638,058 A * 1/1972 Fritzius ..... 313/359.1
7,911,146 B2 * 3/2011 Dunn-Rankin et al. . 315/111.91
8,355,238 B2 * 1/2013 Lee et al. ..... 361/231

* cited by examiner

*Primary Examiner* — Jack Berman
(74) *Attorney, Agent, or Firm* — Altis Law Group, Inc.

(57) ABSTRACT

An ion airflow generating device includes a number of generator stages, each of which includes a number of generators. Each generator includes a needle-shaped emitter and a ring-shaped receiver. The receivers in the same stage are arranged in an array. Each receiver defines a groove in an outer circumferential surface thereof along a direction parallel to the central axis thereof. Each two adjacent receivers in a former generator stage connect with each other, and the grooves thereof cooperatively define a hole for holding an emitter in a next generator stage. The receivers in the next generator stage symmetrically offset from the receivers in the former generator stage such that each emitter aligns to the center of a corresponding receiver.

10 Claims, 2 Drawing Sheets

MULTI-STAGE ION AIRFLOW GENERATING DEVICE

BACKGROUND

1. Technical Field

The present disclosure relates to ion airflow generating devices and, particularly, to an airflow generating device with multiple stages.

2. Description of Related Art

Generally, ion airflow generating devices can include a number of generator stages, each of which can include a number of ion airflow generators. Each ion airflow generator typically includes a needle emitter and a ring receiver. To increase efficiency of the ion airflow generator, a support is employed to hold the needle emitters to point to the center of a corresponding ring receiver. However, the support increases the cost of the ion airflow generating device. Also, the support increases wind resistance loss of the ion airflow generated by the ion airflow generating device.

Therefore, it is desirable to provide an ion airflow generating device which can ameliorate the above-mentioned limitations.

BRIEF DESCRIPTION OF THE DRAWINGS

Many aspects of the present disclosure should be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of the present disclosure will now be described in detail with reference to the drawings.

Figure 1:
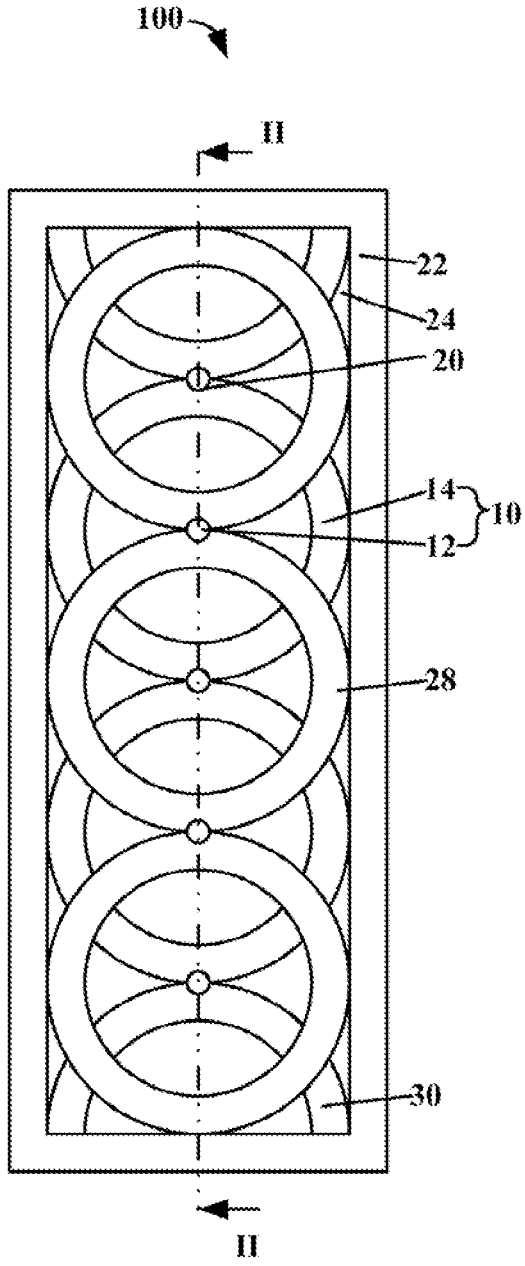
FIG. 1 is a plan view of an ion airflow generating device, according to an embodiment.
Figure 2:
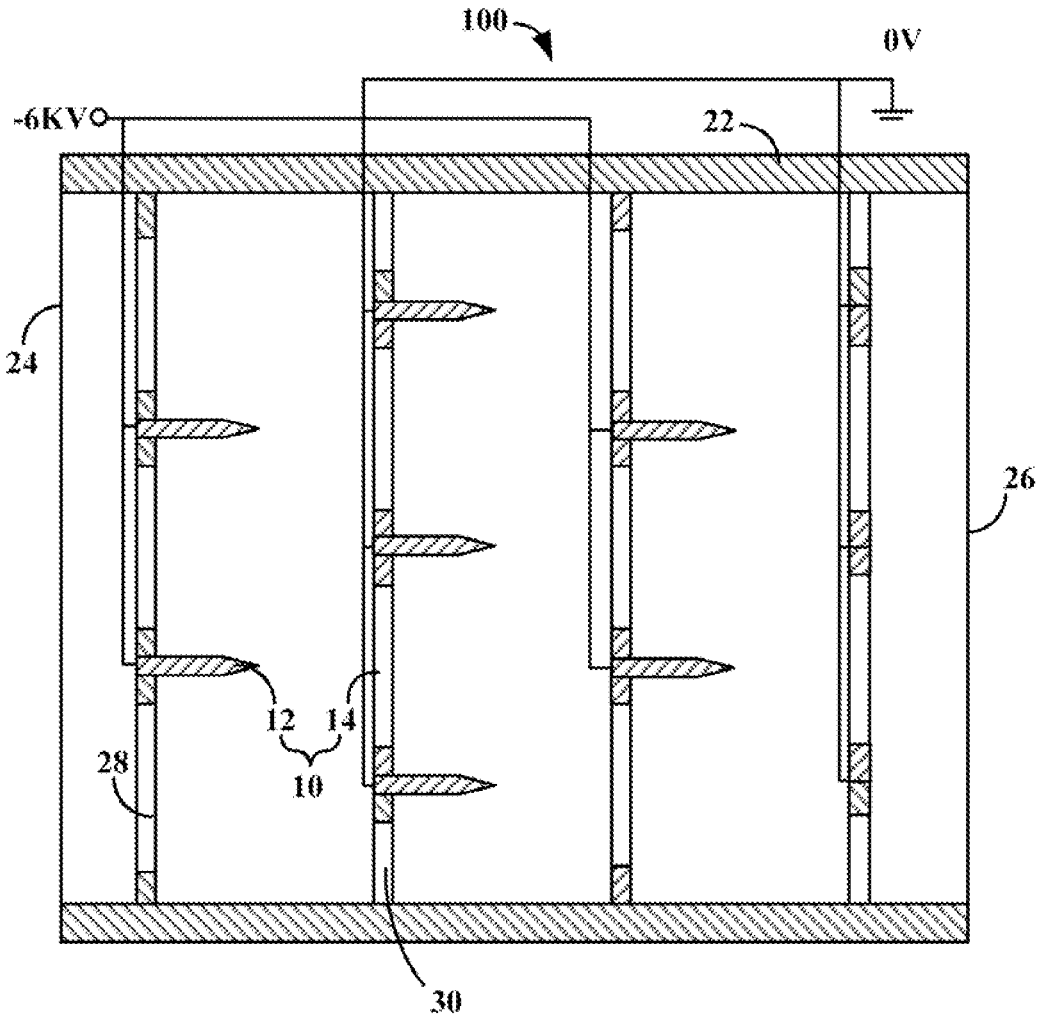
FIG. 2 is a cross-sectional view of the ion airflow generating device, taken along a line II-II of FIG. 1.

Referring to FIGS. 1-2, an ion airflow generating device 100, according to an embodiment, includes three generator stages (not labeled), a guiding tube 22, three connecting rings 28, four connecting semi-rings 30, and a high voltage power supply (shown as −6 KV~0V).

Each of the three generator stages includes a number of airflow generators 10. In particular, the first and third generator stages both include two ion airflow generators 10, and the second generator stage includes three ion airflow generators 10. The ion airflow generators 10 are arranged such that centerlines drawn through each of the ion airflow generators 10 fall between centerlines of the airflow generators 10 in the other stages. Each ion airflow generator 10 includes a needle-shaped emitter 12 and a ring-shaped receiver 14. The receivers 14 in the same stage are linearly arranged. Each receiver 14 defines a groove 20 in an outer circumferential surface along a direction parallel to the central axis thereof. Each two adjacent receivers 14 in the same stage connect with each other, and the grooves 20 thereof cooperatively define a hole for holding an emitter 12 in a next stage. That is, an emitter 12 in a next stage is held between two respective receivers 14 in a former stage. The receivers 14 in a next stage are symmetrically offset from the receivers 14 in a former stage as described above regarding the centerlines. Thus, the emitters 12 in a next stage held between the receivers 14 in a former stage substantially point to the center of the respective receivers 14 to increase efficiency of the generators 10.

In particular, the emitter 12 is a needle electrode, and the receiver 14 is a ring electrode. Both the emitter 12 and the receiver 14 are made of conductive material such as brass.

However, in other alternative embodiments, the emitter 12 can include more than one needle. The receiver 14 can be any of many types of ring-shape, such as a triangular ring, a rectangular ring, a discontinuous ring, a spiral, a set of concentric rings, a set of concentric discontinuous rings, and a set of concentric spirals. In all the variations of the emitters 12 and the receivers 14, the emitters 12 and the receivers 14 satisfy the alignment arrangement described above. If more than one needle is employed in one emitter 12, the needles must be arranged around each other so that all the needles can substantially point to the center of the receiver 14. In this disclosure, 'the center' refers to the geometric center of the receiver 14.

The number of the receivers 14 in the stages is not limited to the number used in this embodiment and can be changed depending on requirements. In particular, more receivers 14 can be employed if a larger area of ion airflow is required. Also, other than linear arrangements (e.g. a single row array) of the receivers 14 in a same stage are acceptable, such as a multi-row array. For instance, the first and third generator stages can both employ eight ion airflow generators 10, and the second generator stage can employ twelve ion airflow generators 10. The receivers 14 in both the first and third stage are arranged in a 2×4 array and the receivers 14 in the second stage are arranged in a 3×4 array.

Moreover, the number of the generator stages is not limited to three, and can be set depending on requirements. In detail, if a stronger ion airflow is required, more than three generator stages can be employed. In contrast, if a weaker ion airflow is required, there be less than three generator stages.

The guide tube 22 sleeves the generator stages, and includes an inlet 24 and an outlet 26, and is configured to guide the ion airflow generated by the generator stages from the inlet 24 to the outlet 26. In this embodiment, the guide tube 22 is a rectangular tube fittingly sleeving the generator stages but is longer than the length of the generator stages. However, the guide tube 22 can be in other configurations that are suitable for housing the generator stages and guiding the ion airflow. The first, second, and third generator stages are arranged in this order from the inlet 24 to the outlet 26. The guide tube 22 can be made of insulative material such as plastic or glass.

The connecting rings 28 are substantially similar to the receivers 14 and linearly arranged. Each connecting ring 28 also defines a groove 20 in an outer circumferential surface along a direction parallel to the central axis thereof. Each two adjacent connecting rings 28 connect with each other and the grooves 20 thereof cooperatively define a hole for holding an emitter 12 in the first stage.

The connecting semi-ring 30 is a half of the connecting ring 28 and configured for connecting the receivers 14 in a stage of which the number of the receivers 14 is less than that of an adjacent stage to the guide tube 22. For example, in this embodiment, the number of the receivers 14 in the first and third stages is less than that of the second stage. Therefore, each two connecting semi-rings 30 are arranged in the first or third stage and connect two sides of the receivers 14 in the first and third stages to the guide tube 22.

The connecting rings 28 and the connecting semi-rings 30 are for supporting the emitters 12 and the receivers 14 in position in the guide tube 22 and therefore can be replaced by other types of support in alternative embodiments.

The high voltage power supply is configured for charging the ion airflow generators 10 and includes a high voltage input 0V and a low voltage input −6 KV. In this embodiment, the emitters 12 in the first and third stages and the receivers 14 in the second stage are connected to the low voltage input −6 KV. The emitters 12 in the second stage and the receivers 14 in the first and third stages are connected to the high voltage input 0V. That is, the emitters 12 in a next stage and the receivers 14 in a former stage share the same voltage input. The emitters 12 and the receivers 14 in the same stage are connected to different voltage inputs to form a voltage drop therebetween.

Since, most of the emitters 12 are held by the receivers 14, a support used in conventional ion airflow generating device can be omitted or simplified. By arranging the receivers 14 not to be in direct line with receivers 14 in adjacent stages, the emitters 12 held between the receivers 14 in a former stage can directly point to the center of the receivers 14, thus a high efficiency of the airflow generating device 100 is achieved.

It will be understood that the above particular embodiments and methods are shown and described by way of illustration only. The principles and the features of the present disclosure may be employed in various and numerous embodiment thereof without departing from the scope of the disclosure as claimed. The above-described embodiments illustrate the scope of the disclosure but do not restrict the scope of the disclosure.

What is claimed is:

1. An ion airflow generating device comprising a plurality generator stages, each generator stage comprising a plurality of generators, each generator comprising a needle-shaped emitter and a ring-shaped receiver, the receivers in the same generator stage being arranged in an array, each receiver defining a groove in an outer circumferential surface thereof along a direction parallel to the central axis thereof, each two adjacent receivers in a former generator stage connecting with each other and the grooves thereof cooperatively defining a hole for holding an emitter in a next generator stage, and the receivers in the next generator stage symmetrically offsetting from the receivers in the former generator stage such that each emitter aligns to the center of a corresponding receiver.

2. The ion airflow generating device of claim 1, wherein the emitter comprises a needle electrode.

3. The ion airflow generating device of claim 1, wherein the emitter is made of brass.

4. The ion airflow generating device of claim 1, wherein the receiver comprises a ring electrode.

5. The ion airflow generating device of claim 4, wherein the receiver is a ring-shape selected from the group consisting of a triangular ring, a rectangular ring, a discontinuous ring, a spiral, a set of concentric rings, a set of concentric discontinuous rings, and a set of concentric spirals.

6. The ion airflow generating device of claim 1, wherein the receiver is made of brass.

7. The ion airflow generating device of claim 1, further comprising a guide tube having an inlet and an outlet, the guide tube sleeving the generator stages and configured for guiding airflow generated by the generator stages from the inlet to the outlet.

8. The ion airflow generating device of claim 7, further comprising a plurality of connecting rings, the configuration of the connecting rings being substantially similar to the receivers, the connecting rings supporting the emitters in a generator stage adjacent to the inlet.

9. The ion airflow generating device of claim 8, further comprising a plurality of connecting semi-rings, the connecting semi-ring is a half of the connecting ring and configured for connecting the receivers in a generator stage of which the number of the receivers is less than that of an adjacent generator stage to the guide tube.

10. The ion airflow generating device of claim 1, further comprising a high voltage power supply configured for charging the generators, the high voltage power supply comprising a high voltage input and a low voltage input, the emitters in the next generator stage and the receivers in the former generator stage connecting to one of the high voltage input and the low voltage input, the receivers in the next generator stage and the emitters in the former generator stage connecting to another one of the high voltage input and the low voltage input, whereby the emitters and the receivers in the same stage are connected to different voltage inputs to form a voltage drop therebetween.

* * * * *